US010540924B2

(12) United States Patent
Lee et al.

(10) Patent No.: US 10,540,924 B2
(45) Date of Patent: Jan. 21, 2020

(54) SOURCE DRIVER

(71) Applicant: SILICON WORKS CO., LTD., Daejeon-si (KR)

(72) Inventors: Jae Kwan Lee, Seoul (KR); Jong Keun Hwang, Seoul (KR)

(73) Assignee: Silicon Works Co., Ltd, Daejeon (KR)

( * ) Notice: Subject to any disclaimer, the term of this patent is extended or adjusted under 35 U.S.C. 154(b) by 0 days.

(21) Appl. No.: 15/409,706

(22) Filed: Jan. 19, 2017

(65) Prior Publication Data

US 2017/0206832 A1 Jul. 20, 2017

(30) Foreign Application Priority Data

Jan. 20, 2016 (KR) ..... 10-2016-0006824
Jan. 11, 2017 (KR) ..... 10-2017-0004291

(51) Int. Cl.
*G09G 3/36* (2006.01)
*G09G 3/32* (2016.01)

(52) U.S. Cl.
CPC ..... *G09G 3/32* (2013.01); *G09G 2320/0295* (2013.01)

(58) Field of Classification Search
CPC ..... G09G 3/32; G09G 2310/027; G09G 2320/0295; G09G 2320/0693
See application file for complete search history.

(56) References Cited

U.S. PATENT DOCUMENTS

2010/0156766 A1* 6/2010 Levey ..... G09G 3/3233 345/78
2010/0295832 A1 11/2010 Nishio et al.
2011/0080442 A1* 4/2011 Ghosh ..... G09G 3/2003 345/694
2011/0193848 A1* 8/2011 Kojima ..... G09G 3/3614 345/211

FOREIGN PATENT DOCUMENTS

KR 10-0836862 6/2008
KR 10-1388286 4/2014
KR 10-2015-0076028 7/2015

* cited by examiner

*Primary Examiner* — Wing H Chow
(74) *Attorney, Agent, or Firm* — Polsinelli P.C.

(57) ABSTRACT

The present invention discloses a source driver that drives a source driver. The source driver is configured in such a manner that a source driving module for driving display data and a conversion module for converting a sensing signal of a display panel into sensing data share components thereof. Thus, the area of the source driver can be reduced.

5 Claims, 4 Drawing Sheets

SOURCE DRIVER

BACKGROUND

1. Technical Field

The present disclosure relates to a source driver, and more particularly, to a source driver that drives a display panel using display data and senses pixels of the display panel.

2. Related Art

A flat panel display device includes a source driver which provides a source signal to display data on a display panel. The source driver is configured to convert display data provided from an external source such as a timing controller into a source signal, and provide the source signal to the display panel.

The display panel may include an LCD (Liquid Crystal Display) panel or LED (Light Emitting Diode) panel. The LCD panel displays a screen using an optical shutter operation of liquid crystal at each pixel, and the LED panel displays a screen by controlling light emission of the LED at each pixel.

For the LED panel, the source driver is configured to sense the characteristics of pixels in the LED panel. When the source driver provides sensing data corresponding to the pixel characteristics, a timing controller or application processor corrects display data using the sensing data. Then, the source driver drives the display panel using the corrected display data. Therefore, the image of the display panel can be expressed with a satisfactory quality, while the influence of the pixel characteristics is reduced.

For this operation, the source driver includes a sensor configured to sense the characteristic of a pixel and output a sensing signal and an analog-digital converter (ADC) configured to output sensing data. In the source driver, the ADC is implemented separately from a source driving module for processing display data. The source driving module includes digital circuits for processing display data and analog circuits for processing a source signal corresponding to the display data.

The source driving module, the sensor and the ADC are implemented at each channel of the source driver that outputs a source signal to the display panel. The source driver provides source signals to the display panel through a large number of channels. Therefore, the source driver fabricated as an integrated circuit includes ADCs corresponding to the number of channels.

Since the ADCs are implemented at the respective channels of the source driver, the ADCs occupy a large area in the source driver. Therefore, the ADCs serve as a factor that increases the area of the source driver fabricated as an integrated circuit.

In other words, the ADCs occupy a large area in the integrated circuit. Thus, the source driver has difficulties in efficiently designing an internal circuit.

SUMMARY

Various embodiments are directed to a source driver capable of reducing the area of a conversion module such that an internal circuit is efficiently designed, because a part of a source driving module for processing display data is shared by the conversion module for converting an analog sensing signal into digital sensing data.

Also, various embodiments are directed to a source driver capable of reducing the area of a conversion module, because the conversion module for converting an analog sensing signal into digital sensing data is implemented using a DAC (Digital-Analog Converter) of a source driving module for processing display data.

Also, various embodiments are directed to a source driver capable of reducing the area of a conversion module, because the conversion module for converting an analog sensing signal into digital sensing data is implemented using a level shifter, a DAC and an output buffer of a source driving module.

In an embodiment, a source driver may include: a source driving module including a DAC (Digital-Analog Converter), and configured to convert display data into a source signal using the DAC, and output the source signal to a display panel; and a conversion module configured to convert first sensing data of a previous period into a first sensing signal using the DAC, and generate second sensing data by updating a comparison result into the first sensing data, the comparison result being obtained by comparing the first sensing signal to a second sensing signal obtained by sensing the display panel at a current period.

In another embodiment, a source driver may include: a latch configured to store display data; a level shifter configured to perform level shifting on the display data of the latch; a register configured to store first sensing data of a previous period; a switching circuit configured to select and provide one of the first sensing data of the register and the display data outputted from the level shifter; a DAC configured to convert the display data provided from the switching circuit into a source signal or convert the first sensing data provided from the switching circuit into a first sensing signal; an output buffer configured to drive the source signal outputted from the DAC; and a comparator configured to compare the first sensing signal and a second sensing signal obtained by sensing a display panel at a current period. The register may generate second sensing data by updating the comparison result of the comparator into the first sensing data.

In another embodiment, a source driver may include: a latch configured to store display data; a register configured to store first sensing data of a previous period; a switching circuit configured to select and provide one of the first sensing data of the register and the display data of the latch; a level shifter configured to perform level shifting on the first sensing data or the display data provided from the switching circuit; a DAC configured to convert the display data provided from the level shifter into a source signal or convert the first sensing data provided from the level shifter into a first sensing signal; an output buffer configured to drive the source signal or the first sensing signal outputted from the DAC; and a comparator configured to compare the first sensing signal driven by the output buffer to a second sensing signal obtained by sensing a display panel at a current period. The register may generate second sensing data by updating the comparison result of the comparator into the first sensing data.

DETAILED DESCRIPTION

Figure 1:
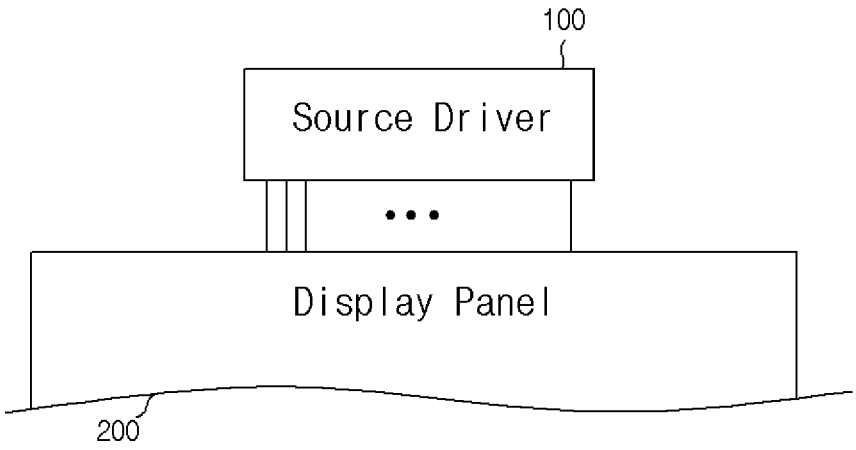
FIG. 1 is a diagram illustrating a connection state between a source driver and a display panel according to an embodiment of the present invention.

Hereafter, embodiments of the present invention will be described in detail with reference to the accompanying drawings. The terms used in the present specification and claims are not limited to typical dictionary definitions, but must be interpreted into meanings and concepts which coincide with the technical idea of the present invention.

Embodiments described in the present specification and configurations illustrated in the drawings are preferred embodiments of the present invention, and do not represent the entire technical idea of the present invention. Thus, various equivalents and modifications capable of replacing the embodiments and configurations may be provided at the point of time that the present application is filed.

An embodiment of the present invention discloses a source driver of a flat panel display device.

The source driver according to the embodiment of the present invention has a function of transmitting sensing data to a timing controller or application processor (not illustrated), the sensing data being obtained by converting a sensing signal of a display panel such as an LED panel of which the pixel characteristics need to be sensed by the source driver.

Referring to FIG. 1, a display device includes a source driver 100 and a display panel 200, and is configured to output source signals from the source driver 100 to the display panel 200, and output sensing signals from the display panel 200 to the source driver 100.

The source driver 100 is configured to recover display data provided from an external source (not illustrated) such as a timing controller, and generate and output source signals using the recovered display data. The source signals are outputted through a plurality of channels of the source driver 100.

The source driver 100 receives sensing signals of the display panel 200 through the respective channels, and samples the received signals. Then, the source driver 100 converts the sampled signals into sensing data which are digital signals, and provides the sensing data to the timing controller or application processor.

The sensing data outputted from the source driver 100 may be used for correcting display data which are to be provided to the source driver 100. The source driver 100 may receive display data corresponding to the correction result, and drive an image with a satisfactory quality to the display panel 200 regardless of the characteristics of the display panel.

Figure 2:
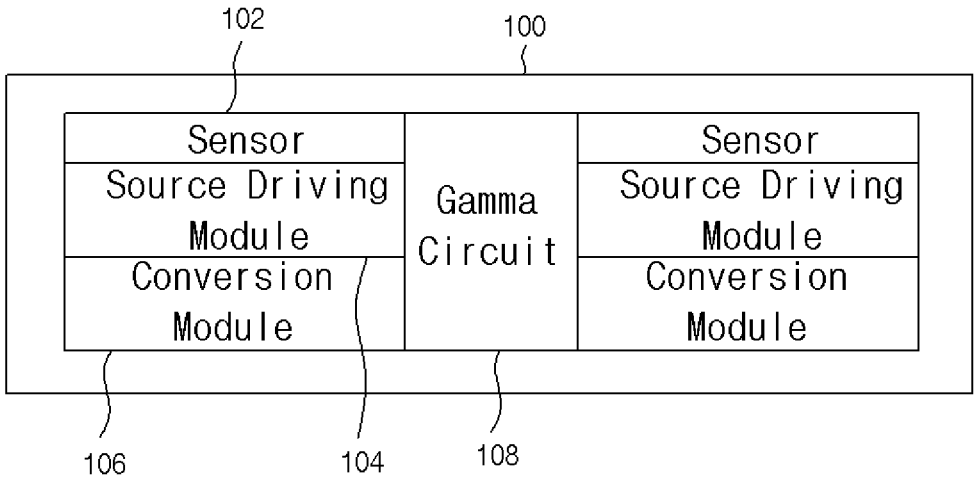
FIG. 2 is a block diagram illustrating a source driver according to an embodiment of the present invention.

Referring to FIG. 2, the source driver 100 may include a sensor 102, a source driving module 104, a conversion module 106 and a gamma circuit 108.

The source driver 100 may be designed in such a manner that the sensor 102, the source driving module 104 and the conversion module 106 are arranged at either side of the gamma circuit 108.

The source driving module 104 of the source driver 100 serves to process display data, and generate and output a source signal. The sensor 102 and the conversion module 106 of the source driver 100 serve to receive a sensing signal, sample the received sensing signal, and generate and output sensing data.

The gamma circuit 108 according to the embodiment of the present invention is configured to provide gamma voltages to the source driving module 104. The source driving module 104 may generate a source signal corresponding to display data using the gamma voltages or sense a first sensing signal corresponding to first sensing data.

The configurations of the sensor 102, the source driving module 104 and the conversion module 106 will be described in detail with reference to FIG. 3.

The sensor 102, the source driving module 104 and the conversion module 106 are implemented at each channel of the source driver 100, which outputs a source signal. That is, the source driving module 104 may be implemented at each channel to output a source signal, and the sensor 102 and the conversion module 106 may be implemented at each channel to receive a sensing signal.

The sensor 102 may sense a current or voltage inputted to a channel of the source driver 100, in order to sense the physical characteristic of a pixel and the characteristic of a line through which a sensing signal is transmitted from the pixel.

For this operation, the sensor 102 includes a comparator 10, and the comparator 10 compares an input voltage INPUT1 corresponding to the current inputted through the channel of the source driver 100 to a preset reference voltage Vref, and outputs an output signal OUTPUT1 as the comparison result. The comparator 10 includes a switch SW1 for resetting operation and a capacitor CS for sampling an output. The sensor 102 may be understood as a buffer for a sensing signal. The output signal OUTPUT1 may be used as an input signal INPUT3 of the conversion module 106, and the input signal INPUT3 will be hereafter referred to as a second sensing signal INPUT3.

The source driving module 104 is configured to output a source signal OUTPUT2 corresponding to display data DATA.

For this operation, the source driving module 104 includes a DAC (Digital-Analog Converter) 24, and is configured to convert the display data DATA into the source signal OUTPUT2 using the DAC 24, and output the source signal OUTPUT2 to the display panel 200.

The conversion module 106 is configured to convert first sensing data of a previous period into a first sensing signal using the DAC 24, compare the first sensing signal to the second sensing signal INPUT3 obtained by sensing the display panel 200 at the current period, and generate second sensing data OUTPUT3 by updating the first sensing data based on the comparison result.

The configurations of the source driving module 104 and the conversion module 106 will be described in detail as follows.

The source driving module 104 includes a latch 20, a level shifter 22, a switching circuit 23, the DAC 24 and an output buffer 26.

The latch 20 is configured to perform a latch operation of storing the display data DATA containing multiple bits inputted in series, and providing the display data DATA in parallel. The latch 20 may include a combination of flip-flops which sequentially latch the multiple bits inputted in series and simultaneously output the multiple bits in parallel to each other in synchronization with an output enable signal (not illustrated).

The level shifter 22 performs level shifting on the display data DATA. That is, the level shifter 22 adjusts the levels of the respective bits of the display data DATA which are stored in the latch 20 and then outputted in parallel, according to the input specification required by the DAC 24.

The switching circuit 23 is configured to select and provide one of the first sensing data stored in a register 34 of the conversion module 106 and the display data DATA outputted from the level shifter 22. For this operation, the switching circuit 23 may include switches SW1 and SW2 connected in parallel to the input side of the DAC 24 through a common node.

The first sensing data and the display data DATA may include an equal number of bits, the switch SW1 may be switched to transmit the display data DATA containing multiple bits from the level shifter 22 to the DAC 24, and the switch SW2 may be switched to transmit the first sensing data containing multiple bits from the register 34 to the DAC 24.

The driving period in which the display data DATA are provided to the switching circuit 23 and the sensing period in which the first sensing data are provided to the switching circuit 23 may be alternately and periodically repeated for one horizontal period of display data DATA. One horizontal period may be divided into a blank period in which no display data are present and a display period in which one horizontal period of display data are present. Thus, the sensing period may be included in the blank period, and the driving period may correspond to the display period.

The DAC 24 is configured to select a gamma voltage corresponding to input data and output the selected voltage as an analog signal. More specifically, the DAC 24 converts the display data DATA provided through the switch SW1 of the switching circuit 23 into the source signal, or converts the first sensing data provided through the switch SW2 of the switching circuit 23 into the first sensing signal.

That is, the DAC 24 selects a gamma voltage corresponding to the digital value of the display data DATA or the first sensing data and outputs the select voltage as the analog signal, and the analog signal outputted from the DAC 24 may be used as the source signal or the first sensing signal.

The output buffer 26 drives the output of the DAC 24, and outputs the driven signal as the source signal OUTPUT2 to the display panel 200, for the driving period.

In the source driving module 104, the latch 20, the level shifter 22, the DAC 24 and the output buffer 26 are enabled for the driving period, and the switch SW1 of the switching circuit 23 is turned on for the driving period. Furthermore, the latch 20, the level shifter 22 and the output buffer 26 are disabled for the sensing period, and the switch SW1 of the switching circuit 23 is turned off for the sensing period.

In the source driving module 104, the switch SW2 of the switching circuit 23 is turned on for the sensing period, and the DAC 24 is enabled to output the first sensing signal for the sensing period, and thus can be used for the operation of the conversion module 106.

The conversion module 106 may include a sample and hold circuit 30, a comparator 32 and a register 34, and share the DAC 24 of the source driving module 104 in order to convert the first sensing data into the first sensing signal. That is, the conversion module 106 may be understood as a component including an analog-digital converter (ADC) which includes the sample and hold circuit 30, the comparator 32 and the register 34 and uses the DAC 24. The register 34 may be implemented with a successive approximation register.

The sample and hold circuit 30 receives the output signal OUTPUT1 of the sensor 102 as the second sensing signal INPUT3. That is, the sample and hold circuit 30 samples and holds the second sensing signal INPUT3, and provides the sampled and held signal to the comparator 32.

The comparator 32 compares the first sensing signal outputted from the DAC 24 to the second sensing signal provided from the sample and hold circuit 30 and provides the comparison result to the register 34, for the sensing period.

The register 34 generates the second sensing data by updating the comparison result of the comparator 32 into the first sensing data, the comparison result corresponding to a difference between the first sensing signal corresponding to the first sensing data of the previous period and the second sensing signal of the current period.

More specifically, the register 34 implemented with a successive approximation register stores the first sensing data of the previous period, generates the second sensing data by updating the first sensing data based on the comparison result of the comparator 32, and output the second sensing data OUTPUT3.

As described with reference to FIG. 3, the source driving module 104 and the conversion module 106 including the ADC implemented therein share the DAC 24.

Figure 3:
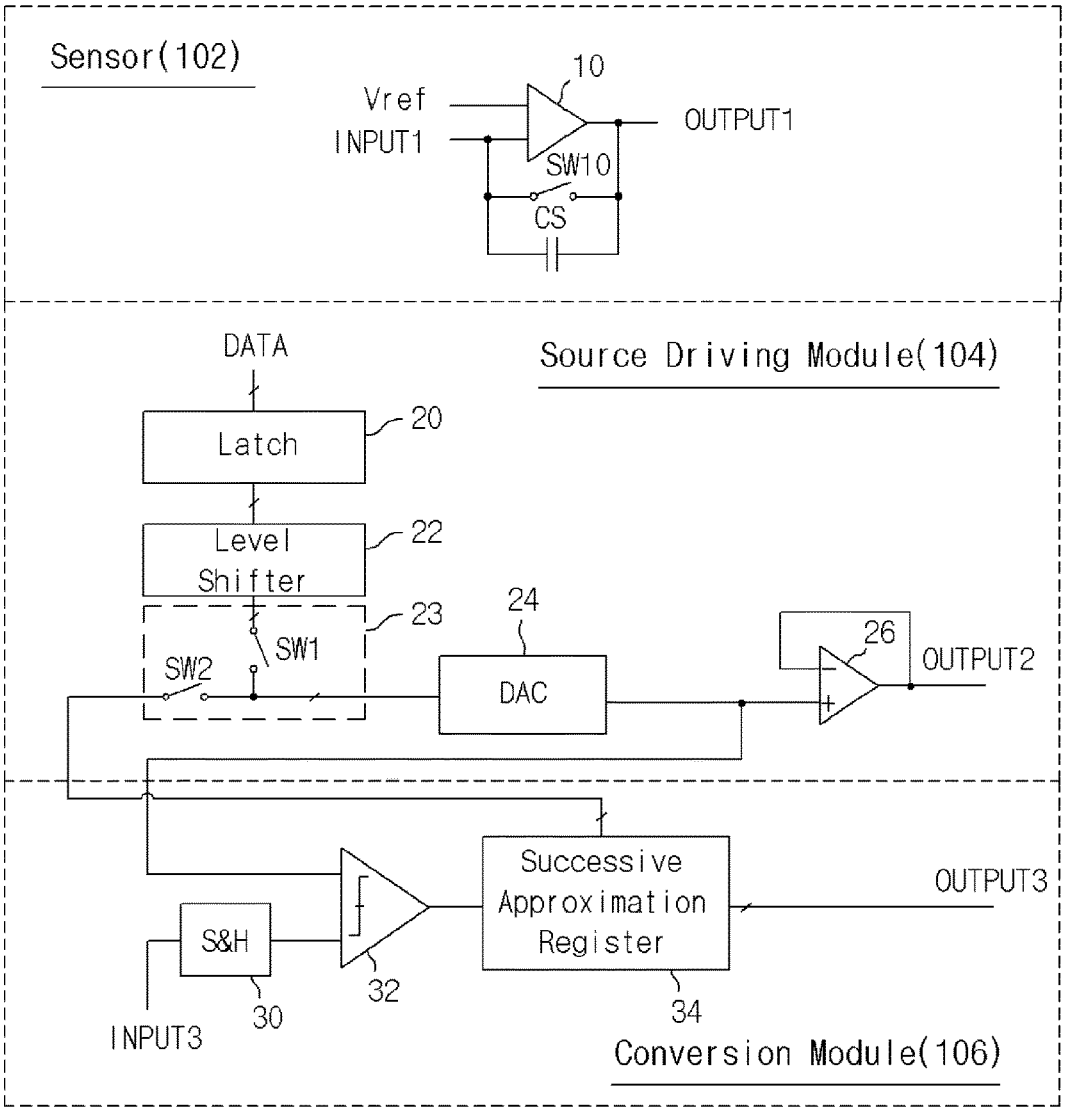
FIG. 3 is a detailed block diagram of the source driver of FIG. 2.
Figure 4:
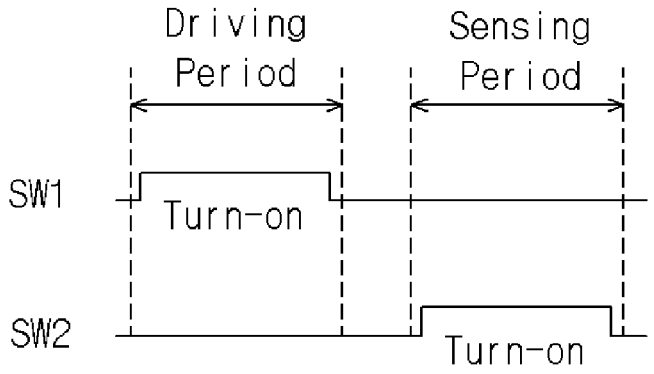
FIG. 4 is a waveform diagram for describing switching states for a driving period and a sensing period.

The conversion module 106 for each channel of the source driver 100 according to the embodiment of the present invention may not include the DAC, according to the configuration of FIG. 3.

Figure 5:
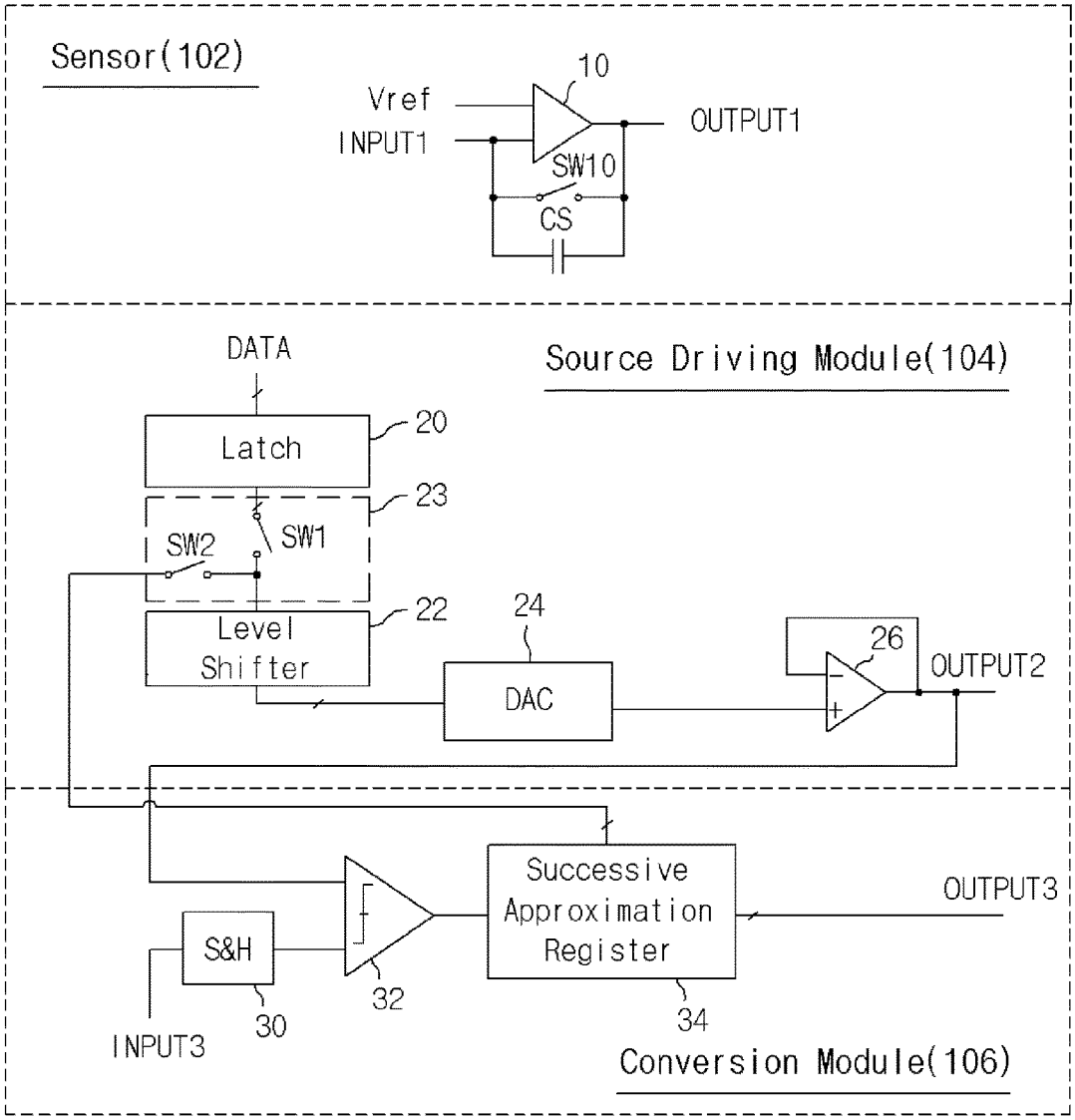
FIG. 5 is a detailed block diagram of a source driver according to another embodiment of the present invention.

The source driver according to the embodiment of the present invention may be embodied as illustrated in FIG. 5. Specifically, the level shifter 22, the DAC 24 and the output buffer 26 of the source driving module 104 may be used to configure the conversion module.

Referring to FIG. 5, the switching circuit of the source driving module 104 may be configured to select one of the first sensing data of the register 34 of the conversion module 106 and the display data DATA provided from the latch 20 and provide the selected data to the level shifter 22.

For this operation, the switching circuit 23 may include switches SW1 and SW2 connected in parallel to the input side of the level shifter 22 through a common node.

The switch SW1 is switched to transmit the display data DATA from the latch 20 to the level shifter 22 for the driving period, and the switch SW2 is switched to transmit the first sensing data from the register 34 to the level shifter 22 for the sensing period.

According to the above-described configuration, the level shifter 22 performs level shifting on the first sensing data or the display data DATA provided from the switching circuit 23, the DAC 24 converts the display data provided from the level shifter 22 into a source signal or converts the first sensing data provided from the level shifter 22 into a first sensing signal, and the output buffer 26 drives the source signal or the first sensing signal outputted from the DAC 24.

Since the operation details of the respective components in the embodiment of FIG. 5 can be understood with reference to the embodiment of FIG. 3, the duplicated descriptions thereof are omitted herein.

As described with reference to FIG. 5, the source driving module 104 and the conversion module 106 including an ADC implemented therein share the level shifter 22, the DAC 24 and the output buffer 26.

The conversion module 106 for each channel of the source driver 100 according to the embodiment of the present invention may not include the DAC, according to the configuration of FIG. 5.

Therefore, the source driver 100 which is embodied as illustrated in FIG. 3 or 5 can reduce the area of the conversion module 106, thereby reducing the whole design area. Thus, the internal circuit can be efficiently designed in an extra space of the chip.

According to the embodiments of the present invention, the conversion module for converting an analog sensing signal into digital sensing data is implemented using a part of the source driving module for processing display data. Thus, the area of the conversion module can be reduced, and the internal circuit of the source driver can be efficiently designed.

Furthermore, since the conversion module is implemented using the DAC of the source driving module or implemented using the level shifter, the DAC and the output buffer of the source driving module, the area of the conversion module can be reduced.

While various embodiments have been described above, it will be understood to those skilled in the art that the embodiments described are by way of example only. Accordingly, the disclosure described herein should not be limited based on the described embodiments.

What is claimed is:

1. A source driver comprising:

a source driving module comprising a DAC (Digital-Analog Converter), and configured to convert display data into a source signal for a driving period, and output the source signal to a display panel; and a conversion module configured to convert first sensing data of a previous period into a first sensing signal for a sensing period, and generate second sensing data by updating a comparison result into the first sensing data, the comparison result being obtained by comparing the first sensing signal to a second sensing signal obtained by sensing the display panel at a current period, wherein the conversion module is implemented as an analog-digital converter using the DAC, and wherein the DAC is shared with the source driving module and the conversion module, converts the display data of the source driving module into the source signal for the driving period, and converts the first sensing data of the conversion module into the first sensing signal for the sensing period.

2. The source driver of claim 1, wherein the source driving module comprises:

a level shifter configured to perform level shifting on the display data;

a switching circuit configured to select and provide one of the first sensing data and the display data outputted from the level shifter; and the DAC configured to convert the display data provided from the switching circuit into the source signal or convert the first sensing data provided from the switching circuit into the first sensing signal; and an output buffer configured to drive the source signal outputted from the DAC.

3. The source driver of claim 1, wherein the source driving module comprises:

a switching circuit configured to select and provide one of the first sensing data and the display data;

a level shifter configured to perform level shifting on the first sensing data or the display data provided from the switching circuit;

the DAC configured to convert the display data provided from the level shifter into the source signal or convert the first sensing data provided from the level shifter into the first sensing signal; and an output buffer configured to drive the source signal or the first sensing signal outputted from the DAC.

4. The source driver of claim 1, wherein the conversion module shares the DAC of the source driving module in order to convert the first sensing data into the first sensing signal, and comprises a comparator configured to compare the first sensing signal and the second sensing signal and a successive approximation register configured to store the first sensing data of the previous period and generate the second sensing data by updating the comparison result of the comparator into the first sensing data.

5. A source driver comprising:

a latch configured to store display data;

a level shifter configured to perform level shifting on the display data of the latch;

a register configured to store first sensing data of a previous period, generate second sensing data for a sensing period, and output the second sensing data;

a switching circuit configured to select and provide the first sensing data of the register for the sensing period or select and provide the display data outputted from the level shifter for a driving period;

a DAC configured to convert the display data provided from the switching circuit into a source signal for the driving period or convert the first sensing data provided from the switching circuit into a first sensing signal for the sensing period;

an output buffer configured to drive the source signal outputted from the DAC for the driving period;

a sample and hold circuit configured to provide a second sensing signal obtained by sensing a display panel at a current period; and a comparator configured to compare the first sensing signal and the second sensing signal for the sensing period, wherein the register generates the second sensing data by updating a comparison result of the comparator into the first sensing data, and wherein the sample and hold circuit, the comparator, and the register are implemented as an analog-digital converter using the DAC.

* * * * *